United States Patent [19]

Kondo

[11] Patent Number: 5,025,354

[45] Date of Patent: Jun. 18, 1991

[54] COMPACT HAVING AN ILLUMINATOR

[76] Inventor: Yoshio Kondo, Paradion Sugaguchi 501, 1-26 Sugaguchi Ekimae, Shinkawacho, Nishikasugai District, Aichi Prefecture, Japan

[21] Appl. No.: 531,875

[22] Filed: Jun. 1, 1990

[30] Foreign Application Priority Data

Dec. 26, 1989 [JP] Japan ..... 1-149956[U]
Mar. 9, 1990 [JP] Japan ..... 2-23918[U]

[51] Int. Cl.[5] ..... F21V 33/00
[52] U.S. Cl. ..... 362/135; 362/137; 362/154
[58] Field of Search ..... 362/154, 156, 135, 136, 362/137

[56] References Cited

U.S. PATENT DOCUMENTS 3,619,596 11/1971 Jackson ..... 362/156
3,938,132 2/1976 Cunningham ..... 362/154
4,126,145 11/1978 Boyd ..... 362/156
4,269,206 5/1981 Boyd ..... 362/156

*Primary Examiner*—Ira S. Lazarus
*Assistant Examiner*—Sue Hagarman
*Attorney, Agent, or Firm*—Bauer & Schaffer

[57] ABSTRACT

An illuminated compact having an upper case provided with an illuminator and a mirror and a lower case accommodating a variety of cosmetics. When the upper and lower cases are opened, the illuminator is automatically turned on, thereby making it possible to make up the face even in a dark place. The illuminator is provided with means whereby light irradiates the entire face of the user. The illuminator is automatically turned off when the upper and lower cases are closed.

2 Claims, 7 Drawing Sheets

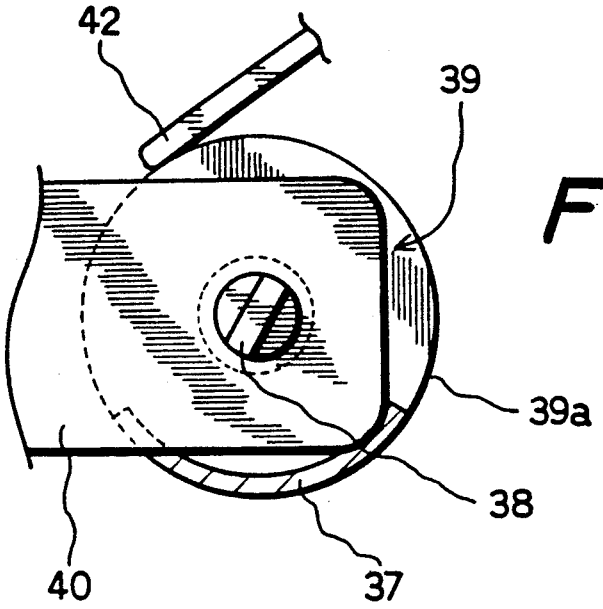
FIG.9(b)
FIG.10
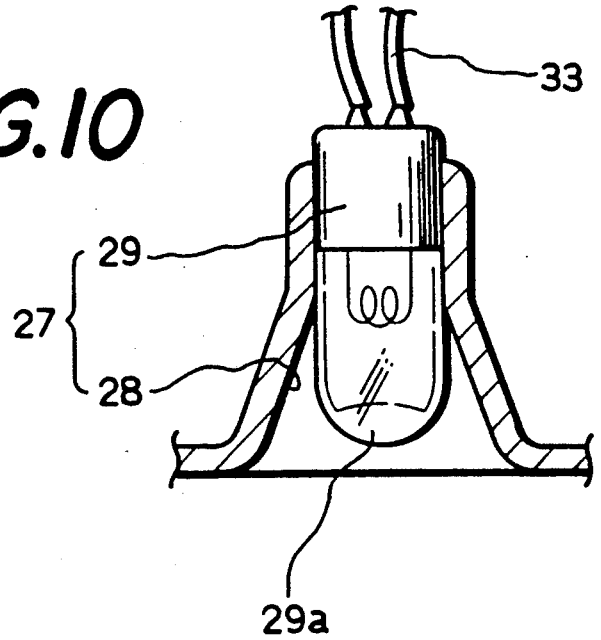

COMPACT HAVING AN ILLUMINATOR

BACKGROUND OF THE INVENTION

1. Filed of the Invention

The present invention relates to a portable compact for makeup, and more particularly, to a compact having an illuminator which allows a person to make up the face even in a dark situation such as at night.

2. Description of the Prior Art

A conventional portable compact for makeup consists mainly of an upper case having a mirror fixed typically on the bottom side thereof and a lower case in which a variety of cosmetics are contained. These upper and lower cases are hinged so as to be freely opened and closed. Also such compact is provided with a stopper means for maintaining the upper and lower cases in a closed state.

Such conventional portable compact must be used, as an absolute condition, in a situation where the face and its surroundings, of a person who is going to make up the face, is sufficiently lighted so as to be clearly reflected in a mirror arranged in the upper case of the compact. Therefore, the above. mentioned conventional compact does not allow a person to make up even during the daytime if she is in a place where her face is not sufficiently lighted. In some cases, it is impossible to make up with such conventional compact unless the face is lighted by a illumination or the like.

OBJECTS AND SUMMARY OF THE INVENTION

In view of the above inconvenience, it is an object of the present invention to provide a compact having an illuminator which permits a person to make up the face even in a dark situation, e.g. at night To achieve the above object, the present invention provides an illuminated compact comprising a compact body formed of an upper case and a lower case. A light transmittable element is provided for transmitting the light emitted from an illuminating lamp to the face of the user. A switch for automatically turning on and off the illuminating lamp, operable upon opening and closing the upper case and the lower case, is provided. In addition, a mnul switch is included to enable long term storage of the compact without drainage of the battery.

The above and other objects, features and advantages of the present invention will become apparent from the following detailed description of the preferred embodiment taken in conjunction with the accompanying drawings, throughout which like reference numerals designate like elements and parts.

BRIEF DESCRIPTION OF THE DRAWINGS

FIG. 9*b* is a plan view showing how the automatic switch is operated; and

FIG. 10 is a side view of an illuminator employed in the compact of the present invention.

DETAILED DESCRIPTION OF THE PREFERRED EMBODIMENTS

Figure 1:
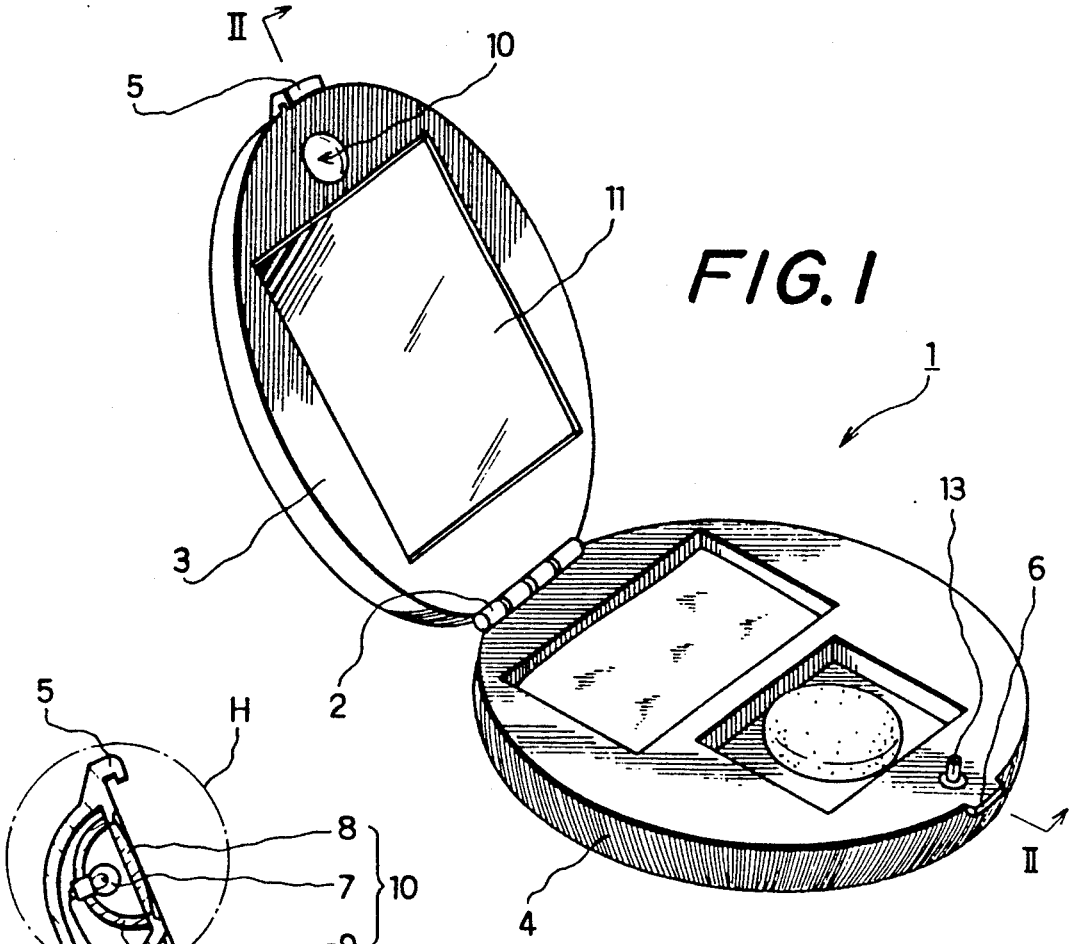
FIG. 1 is a perspective view showing an embodiment of a compact having an illuminator according to the present invention.
Figure 2:
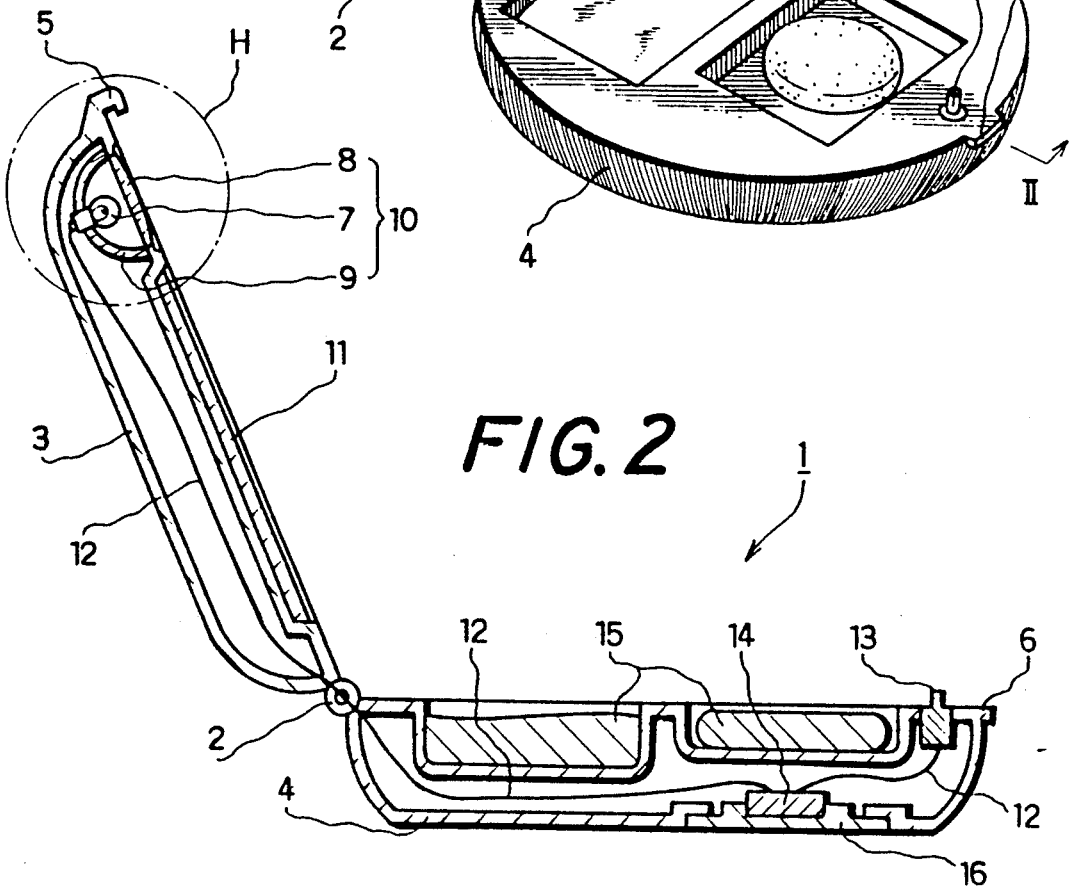
FIG. 2 is a cross-sectional view taken along a line II— II in FIG. 1.

A first embodiment of the present invention will now be explained with reference to FIGS. 1 through 4.

In these drawings, a compact body 1 comprises an upper case 3 and a lower case 4 which are coupled by a hinge 2. The upper and lower cases 3, 4 are respectively provided with a hook 5 and detent 6 which are engaged and disengaged for closing and opening the upper and lower cases 3, 4. The upper case 3 is also provided with a illuminating lamp 7, an illuminator comprising a light transmittable element 8 and a reflector 9, a mirror 11 and a wire 12 accommodated therein. In the lower case 4 there are accommodated a battery (e.g. a mercury battery) 14 and a variety of cosmetics 15. An automatic switch 13 is arranged so as to be turned off when the upper and lower cases 3, 4 of the compact body 1 are closed and thereby an end of the automatic switch 13 hits against the upper case 3 and turned on when the compact body 1 is opened. In other words, the upper and lower cases 3, 4 are opened by disengaging the hook 5 and the detent 6, and at the same time the automatic switch 13 is turned on to automatically light the illuminating lamp 7. The lower case 4 is provided at its bottom surface with a removable container 16 in which the battery 14 is accommodated.

Figure 3A:
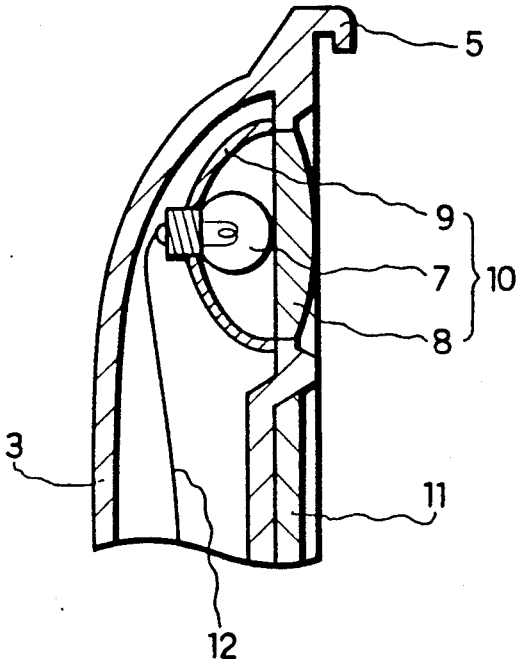
FIGS. 3*a* and 3*b* ar are enlarged cross-sectional views respectively showing a main portion of the compact having an illuminator.

The illuminator 10, as mentioned above, comprises a light transmittable element 8 attached between the mirror 11 and the hook 5 in the upper case 3, and the illuminating lamp 7, disposed in the upper case 3, is provided with a reflector 9. A light emitted from the lit illuminating lamp 7 is converged or diffused to the light transmittable element 8 by the reflector 9. The light transmittable element 8 employed in the present embodiment is a lens as shown in FIG. 3*a* which may be a concave or convex one which allows the light reflected by the reflector 9 to irradiate the face satisfactorily. A concave lens converges the beam once converged or diffused by the reflector 9. A convex lens diffuses the beam so as to irradiate the entire face.

Figure 3B:
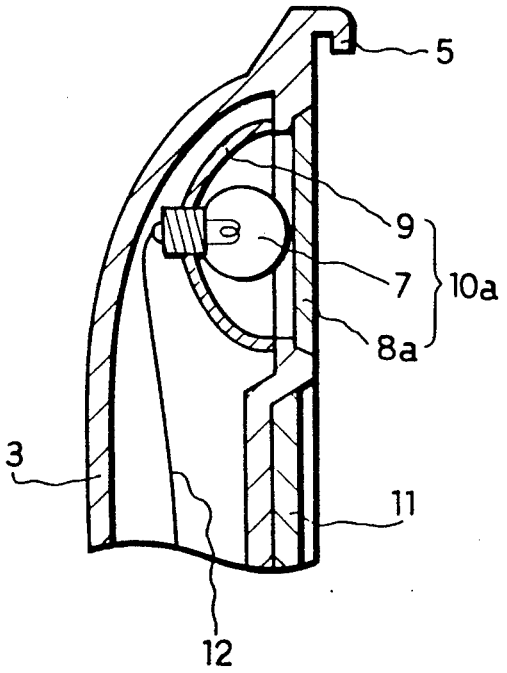
Figure 4:
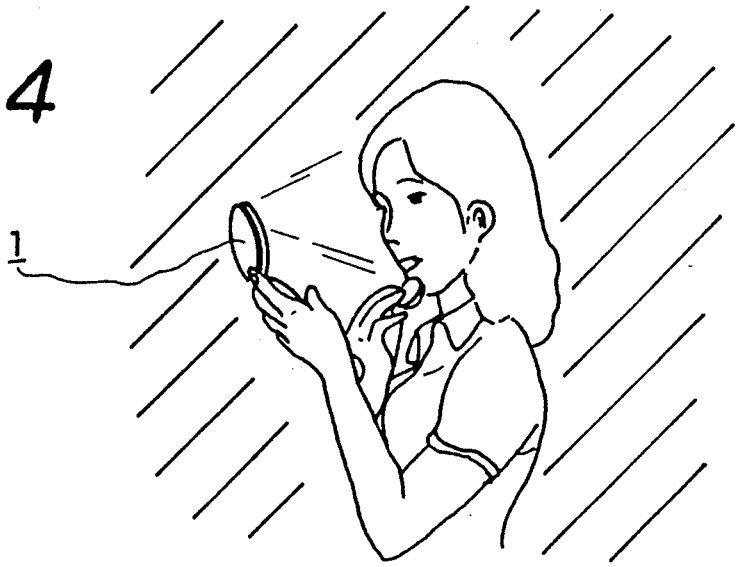
FIG. 4 is a perspective view showing how the compact having an illuminator is used.
Figure 5:
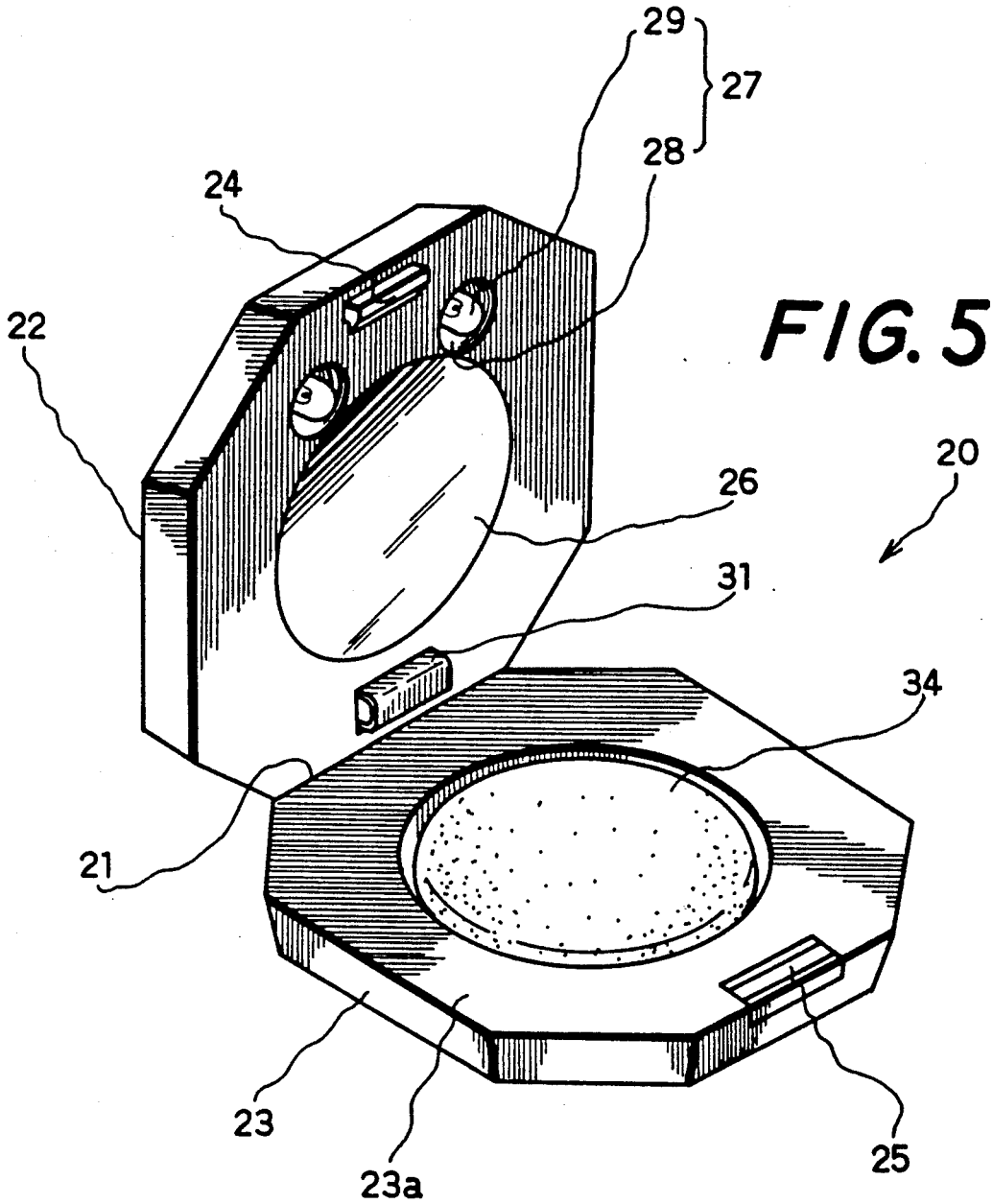
FIG. 5 is a perspective view showing another embodiment of a compact having an illuminator of the present invention.
Figure 6:
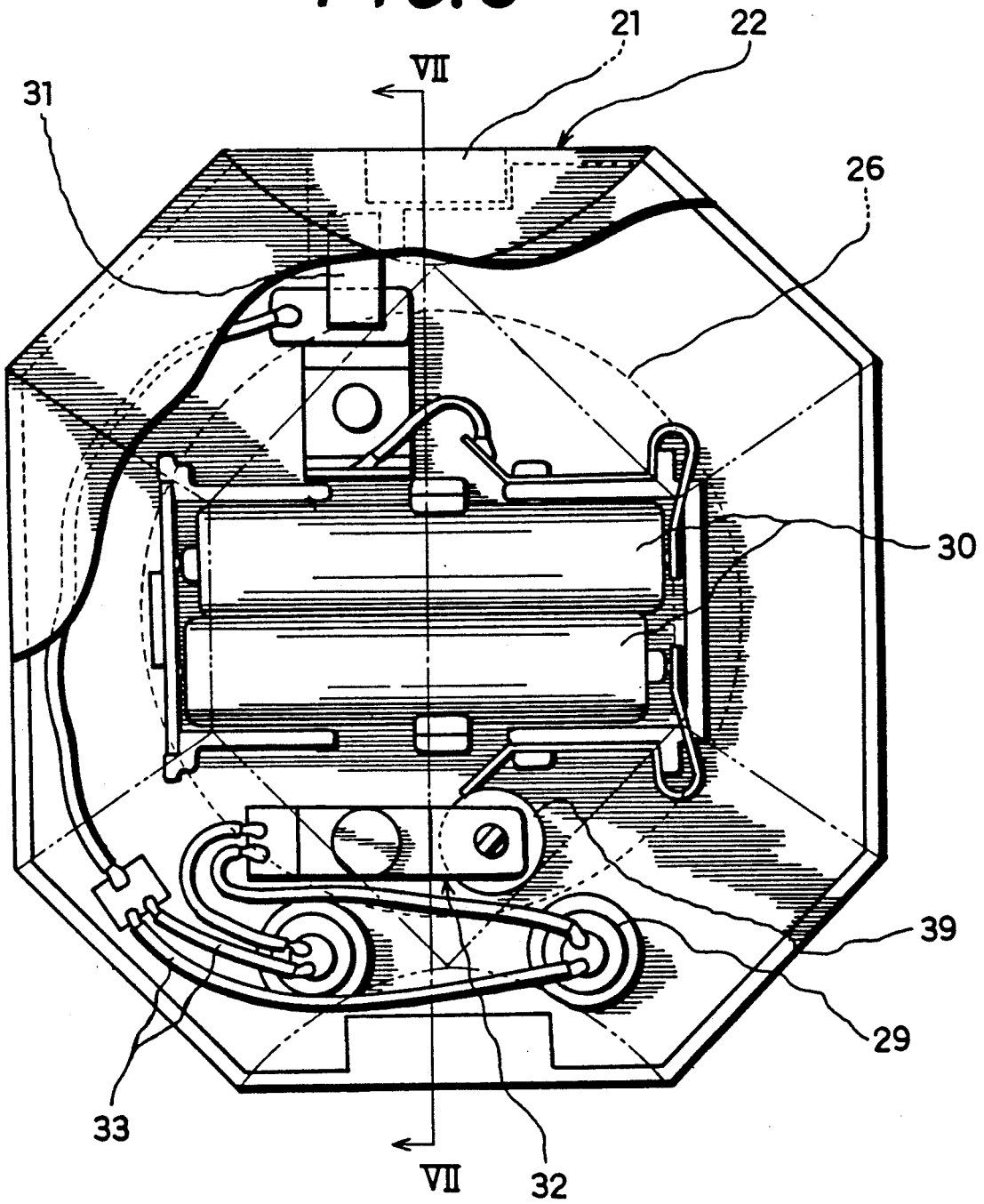
FIG. 6 is a top plan view of the compact having an illuminator.
Figure 7:
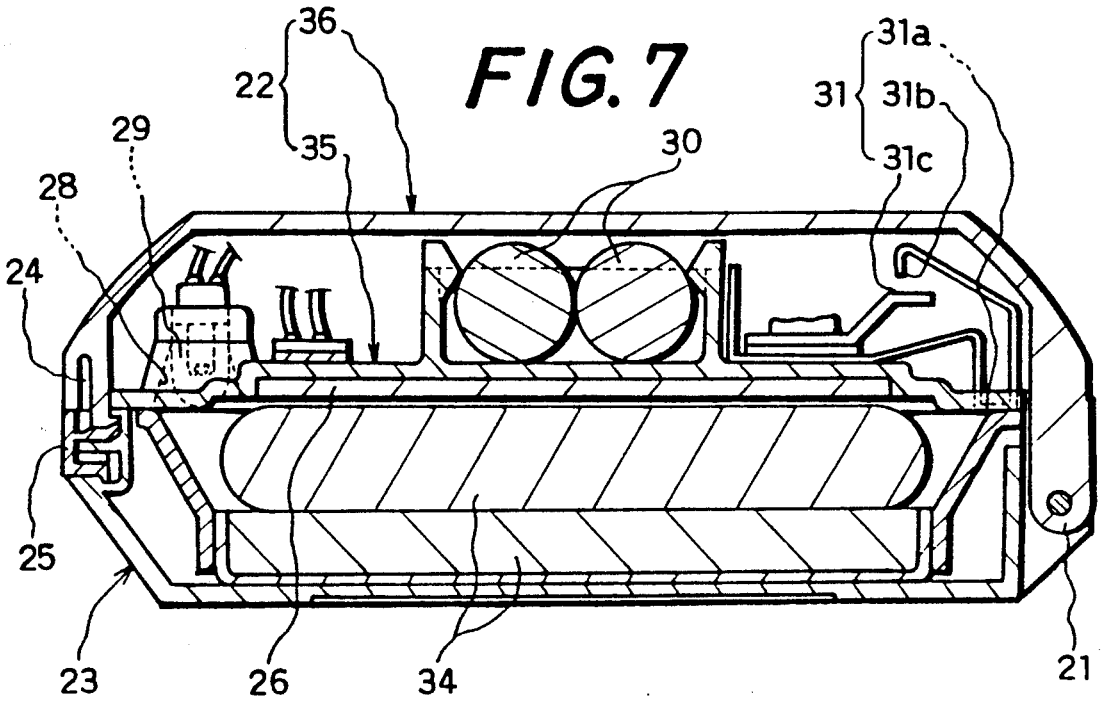
FIG. 7 is a cross-sectional view taken along a line VII— VII in FIG. 6.
Figure 8:
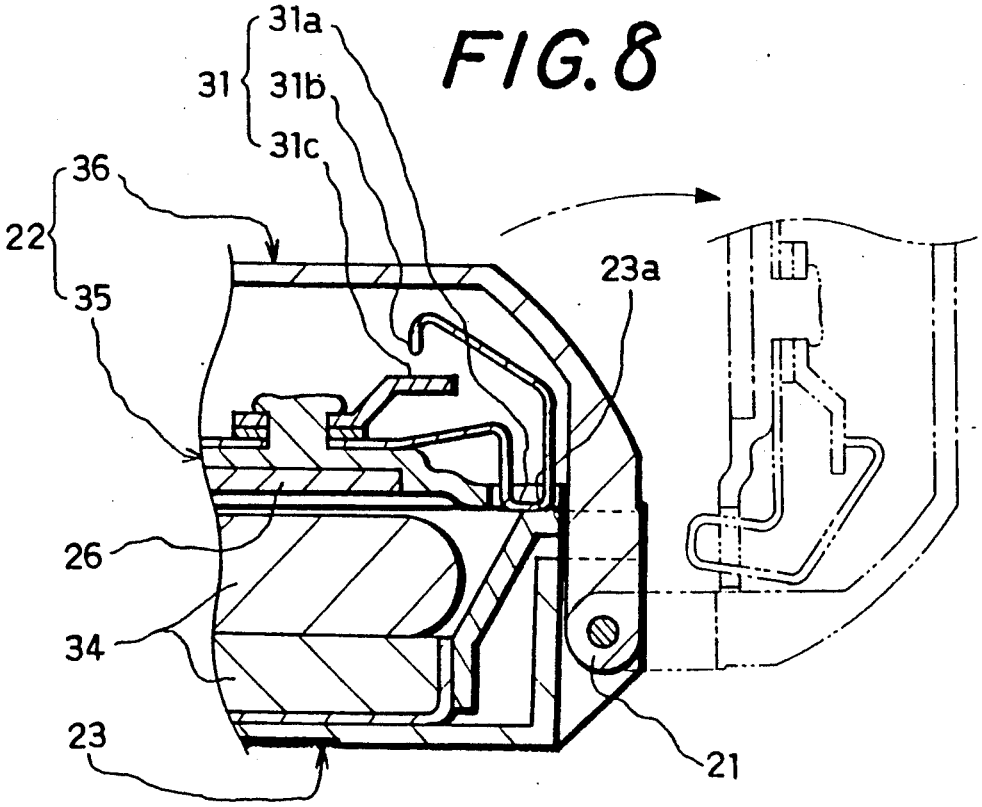
FIG. 8 is an enlarged cross-sectional view of an automatic switch employed in the compact having an illuminator of the present invention.

The illuminator 10*a* as shown in FIG. 3*b* employs a plane light transmittable element 8*a* through which a diffused light beam by the reflector 9, adjusted so as to diffuse the light beam from the illuminating lamp 7, irradiates the entire face in the same manner as the case where a concave or convex lens is employed as the light transmittable element 8. The light beam from the illuminating lamp 7 can irradiate the entire face by the action of the reflector 9 and the light transmittable element 8 or only the reflector 9. Incidentally, a wire 12 is illustrated in the form of a line in FIG. 2, in which plus and minus poles are omitted for the sake of simplicity.

Next, another embodiment of the present invention will be explained with reference to FIG. 5 through 10.

In these drawings, a compact body 20 comprises an upper case 22 and a lower case 23 which are coupled by a hinge 21. The upper and lower cases 22, 23 are respectively provided with a hook 24 and a dent 25 which are engaged and disengaged to close and open the upper and lower cases 22, 23. The upper case having a mirror 26 is also provided with an illuminator 27 which comprises an illuminating lamp 29 with a reflector 28. Further, the upper case 22 has a battery 30, an automatic switch 31 and a manual switch 32, electrically connected with one another through a wire 33. In the lower case 23, there are accommodated a variety of cosmetics 34. The upper case 22 consists of a removable cover 35 and a case body 36, i.e. it has a so-called separable double structure, so that the cover 35 can be removed from the case body 36 to allow operations of the manual switch 32 and replacement of the battery 30 and the illuminating lamp 29 to be easily achieved. The battery 30 may be a mercury battery in place of a conventional dry battery.

The automatic switch 31 is arranged to be turned off when the compact body 20 is closed, wherein an end 31*a* of the automatic switch 31 hits against an edge 23*a* of the lower case 23. By this action, the end 31*a* is lifted to disconnect the contacts 31*b* and 31*c* from each other and consequently turn off the automatic switch 31. When the compact body 20 is opened, the lifted end 31*a* is repositioned to the previous position by its elasticity, so that the contacts 31*b* and 31*c* are connected to thereby turn on the automatic switch 31.

Figure 9A:
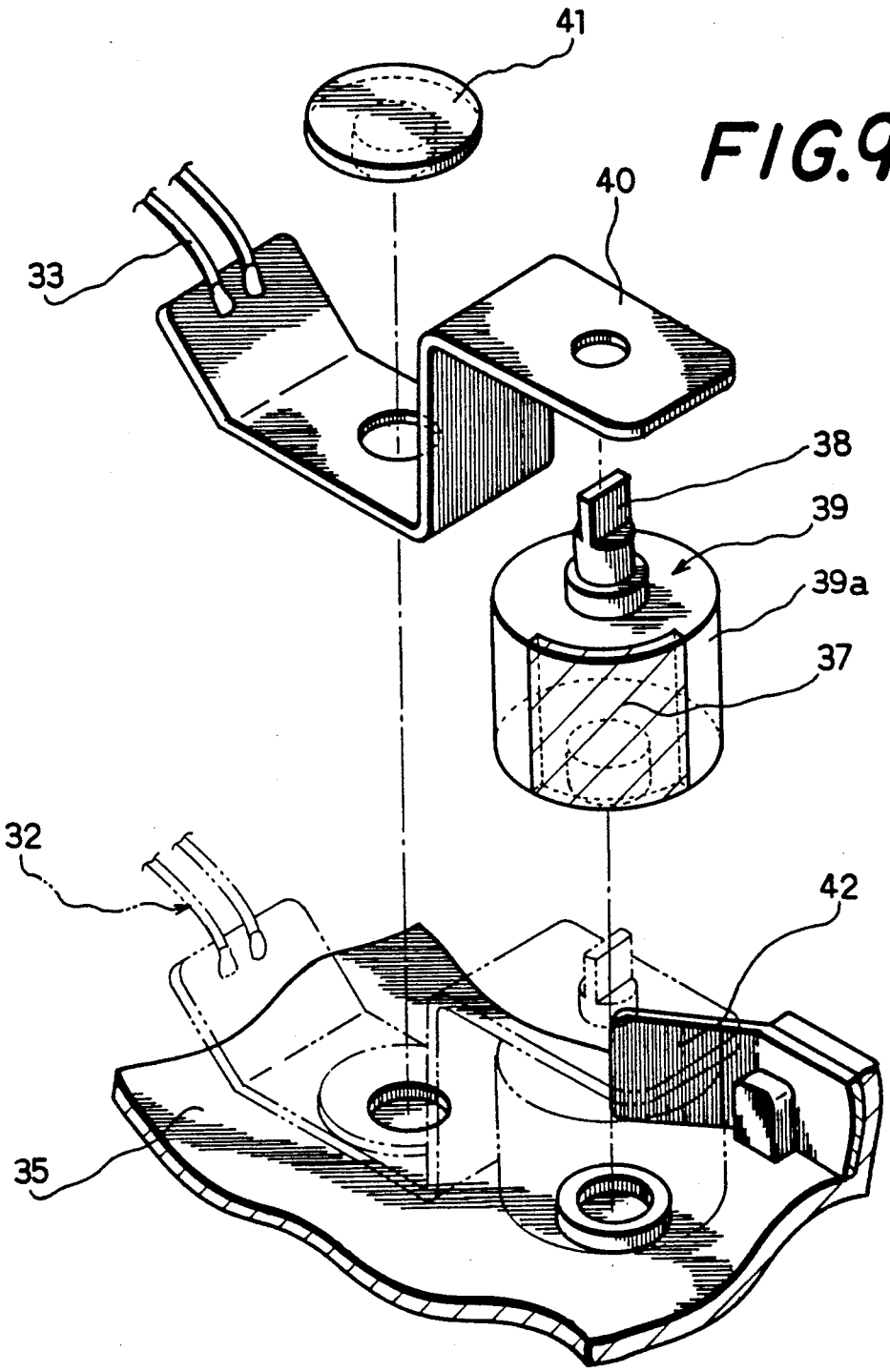
FIG. 9*a* is a perspective view showing how the automatic switch is assembled.

The manual switch 32, as shown in FIG. 9*a*, is provided with a cylinder 39 rotatable by manually rotating an associated knob 38, and an electrode plate 40 which has one end connected to a code 33 connected with the battery 30 and the other end attached to the rotatable cylinder 39. The cylinder 39 has a conductive circumferential portion 39*a* and an insulating circumferential portion 37 for interrupting a current. The manual switch is attached to the cover 35 of the upper case 22 by a fixing bolt 41. It is therefore necessary to first remove the cover 35 from the case body 36 of the upper case 22 to operate the manual switch 32. Since the conductive portion 39*a*of the rotatable cylinder 39 and the electrode plate 40 are made of conductive material, the manual switch 32 is turned on when a terminal 42 connected with the battery 30 comes into contact with a conductive portion, 39*a* of the cylinder 39, whereby a current flows through the wire 33 connected to the electrode plate 40 from the rotatable cylinder 39. On the contrary, the manual switch 32 is turned off if the terminal 42 is contacted with the insulating portion 37 by rotating the cylinder 39 by the knob 38.

Incidentally, the illuminator 27 employed in the present embodiment is such one, as shown in FIG. 10, that has a lens 29*a* as a glass member of the illuminating lamp 29, in place of the light transmittable element 8 of FIG. 3. However, the illuminators 10, 10*a* as shown in FIG. 3 may be employed instead, in which case the same operation and effects can be produced as the previously mentioned case.

What is claimed is:

1. An illuminated compact for use in applying cosmetics to a user's face, operable automatically on opening and closing the compact, said compact comprising a body formed of an upper case and a lower case, said upper case having an illuminating lamp, a reflecting means for collecting light emitted from said lamp, and a light transmittable element diffusing the collected light, said light transmittable element irradiating said light onto the face of the user, and said lower case having a place for accommodating one or more of a variety of cosmetics, said upper case having a removable cover and an automatic switch, a battery, and a manual switch placed therein, said manual switch comprising a cylinder rotatable by manually rotating a knob and having an insulating portion for interrupting an electrical current, and an electrode plate, one end of which is coupled to the battery and the other end of which is coupled to said rotatable cylinder.

2. The compact according to claim 1, wherein the light transmittable element comprises a lens.

* * * * *